US007584852B2

(12) United States Patent
O'Brien et al.

(10) Patent No.: US 7,584,852 B2
(45) Date of Patent: Sep. 8, 2009

(54) BOTTLE SHIPPER, SHIPPING PROTECTOR, SHIPPING SYSTEM AND METHOD

(75) Inventors: Sean M O'Brien, Corvallis, OR (US); Richard B Hurley, Corvallis, OR (US); Mark W Betts, Corvallis, OR (US)

(73) Assignee: Western Pulp Products Co., Corvallis, OR (US)

( * ) Notice: Subject to any disclaimer, the term of this patent is extended or adjusted under 35 U.S.C. 154(b) by 169 days.

(21) Appl. No.: 11/676,678

(22) Filed: Feb. 20, 2007

(65) Prior Publication Data

US 2008/0197037 A1 Aug. 21, 2008

(51) Int. Cl.
*B65D 85/30* (2006.01)
*B65D 65/00* (2006.01)

(52) U.S. Cl. ..... 206/591; 206/433

(58) Field of Classification Search ..... 206/588, 206/589, 459.1, 494, 440, 459.5, 812, 438; 220/507–519

See application file for complete search history.

(56) References Cited

U.S. PATENT DOCUMENTS

| | | | | | |
|---|---|---|---|---|---|
| 1,367,069 | A | | 2/1921 | MacKinnon | |
| 2,085,104 | A | | 6/1937 | Levinson | |
| 2,145,879 | A | | 2/1939 | Jewett | |
| 2,339,176 | A | | 1/1944 | Lee | |
| 2,540,392 | A | | 2/1951 | Haskell | |
| 2,615,749 | A | | 10/1952 | Kuchel | |
| 2,670,124 | A | | 2/1954 | Buchmiller et al | |
| 2,670,984 | A | | 3/1954 | Arthur | |
| 2,690,254 | A | * | 9/1954 | White | 206/422 |
| 2,766,919 | A | | 10/1956 | Randall | |
| 2,826,346 | A | | 3/1958 | Randall | |
| 2,896,829 | A | | 7/1959 | Bright | |
| 2,897,974 | A | | 8/1959 | Cook | |
| 2,994,438 | A | | 8/1961 | Nelson | |
| 3,056,523 | A | | 10/1962 | Reifers | |
| 3,162,344 | A | | 12/1964 | Sabol | |
| 3,164,257 | A | | 1/1965 | Foy | |
| 3,315,858 | A | | 4/1967 | Homer | |
| 3,353,729 | A | | 11/1967 | Hull | |
| 3,572,534 | A | | 3/1971 | Benoit | |
| D227,851 | S | | 7/1973 | Nowland et al. | |
| 3,966,102 | A | | 6/1976 | Clark | |
| 4,006,818 | A | * | 2/1977 | Wannyn | 206/564 |
| 4,032,006 | A | * | 6/1977 | Cantarella et al. | 206/778 |
| 4,101,031 | A | * | 7/1978 | Cromie | 206/438 |
| 4,231,510 | A | * | 11/1980 | Beard | 206/422 |
| 4,381,847 | A | | 5/1983 | Bessett et al. | |
| D279,259 | S | | 6/1985 | Bixler et al. | |
| D289,010 | S | | 3/1987 | Vigue | |
| D290,580 | S | | 6/1987 | Vigue | |
| D310,027 | S | | 8/1990 | Bixler | |
| D319,579 | S | | 9/1991 | Vigue | |
| 5,096,065 | A | | 3/1992 | Vigue | |
| D331,008 | S | | 11/1992 | Vigue | |
| D384,275 | S | | 9/1997 | DuBois | |
| 5,713,619 | A | | 2/1998 | DuBois | |
| 5,857,583 | A | | 1/1999 | Chantaca et al. | |

(Continued)

*Primary Examiner*—Kaushikkumar Desai
(74) *Attorney, Agent, or Firm*—patenttm.us

(57) ABSTRACT

A bottle shipping protector employs a flexible flange member adapted to move as biased against a bottle to accommodate a wide variety of bottle configurations for shipping with minimal movement of the bottle relative to the shipping protector, minimizing abrasion of the bottle labels and capsules.

23 Claims, 21 Drawing Sheets

U.S. PATENT DOCUMENTS

| | | | | |
|---|---|---|---|---|
| 6,076,876 | A | 6/2000 | Letourneau et al. | |
| D436,853 | S | 1/2001 | Sussman | |
| D438,100 | S | 2/2001 | Cekota | |
| 6,213,297 | B1 | 4/2001 | Gale | |
| 6,336,556 | B1 | 1/2002 | Gale | |
| 6,364,151 | B1 | 4/2002 | Gale | |
| 6,398,056 | B1 | 6/2002 | Letourneau et al. | |
| 6,527,116 | B1 | 3/2003 | Gale | |
| 6,651,836 | B1 | 11/2003 | Hofheins et al. | |
| 6,679,380 | B2 | 1/2004 | Brown | |
| 6,820,743 | B2 * | 11/2004 | Hurley et al. | 206/427 |
| 2004/0031711 | A1 * | 2/2004 | O'Malley | 206/427 |

* cited by examiner

10

BOTTLE SHIPPER, SHIPPING PROTECTOR, SHIPPING SYSTEM AND METHOD

BACKGROUND OF THE INVENTION

This invention relates to shipping of bottles or containers, and more particularly to an apparatus, system and method for protecting such bottles or containers during shipping.

It is often desirable to ship bottles or other vessels, typically containing liquids. However, the typical shipping environment is replete with situations that can result in damage to the vessels and their contents. In the wine industry, for example, especially in the high end product lines or in gift packaging or monthly shipping "club" industries, it is common practice to ship wine, in a corrugated shipping carton with some type of protection to prevent the bottles from becoming broken and spilling their contents during shipping or to prevent labels or capsules, the plastic or foil closure portion that covers the cork and part of the neck of a wine bottle, or the foil or plastic covered wire cage cork retainer as employed with the punt style champagne bottles, from being abraded. This is also the case for shipping of, for example, protein drinks, culinary liquids, mineral water or other specialty waters.

In the past, plastic packaging material including plastic foams, such as polystyrene foams, styrene acrylonitrile copolymer foams, polyethylene foams, polyethylene copolymer foams, expanded polyethylene bead foams, polyurethane foams, vacuum formed plastic such as PET (polyethylene terephthalate), as well as corrugated inserts (whether plastic or paper based) have been used as a protective packaging inserts, hereinafter called shipping protectors, wherein various configurations of shipping protectors are employed to provide layers or defined spaces for maintaining the bottles in spaced relation to one another. With these types of shipping protectors, a number of different types and configurations of shipping protectors may be needed to accommodate different bottle shapes and sizes. Since different shipping protector types might be needed for the different bottle shapes, it can become difficult to predict how many of each shipping protector item should be kept in inventory. This has lead to a multitude of different wine shipping protectors being introduced in an attempt to accept the widest range of bottle geometries.

Other wine bottle shipping protectors employ a mating pair configuration wherein two parts form a paired type shipping protector (whether hinged or separate unhinged portions) such that each layer of bottles requires a pair of shipping protector parts to completely surround the bottles, i.e., from above and below. Such shipping protector, whether made of plastic or of molded pulp, also referred to molded fiber, typically employ a bottle engaging geometry configuration on one face thereof and support surfaces on the opposite side such that in order to properly pack and protect a row of wine bottles, two such shipping protectors are positioned around the bottles, i.e., a receiving layer below and a paired or mating layer above, with the bottle engaging geometries of the two shipping protector pieces face-to-face and the support foot side of each protector piece facing outwardly with respect to the bottles.

Shipping protectors are commonly provided in single bottle, double bottle or 3, 4, 6 or 12 bottle configurations, for example, designed to receive and ship the bottle in either a stand up or lay down configuration.

With the various configurations of shipping protectors, it becomes critical during loading of the shipping carton that the particular shipping protector parts be oriented correctly both with respect to top to bottom and left to right orientation within the package in order to ensure that the bottles and packing fit efficiently within the shipping carton. Not providing this orientation can slow down throughput in high volume shipping operations, since the packer must properly orient the unstacked shipping protector to ensure that it is of the correct orientation prior to beginning the packing process in order to receive the bottles.

A larger problem with the high speed packaging fulfillment operations, monthly wine shipping clubs and the like is the need for universality of a shipping protector. A big cost (of time) is the situation when a bottle comes down the packing line and the bottle is of a non-traditional size or shape that will not fit within the industry standard shipping protectors. If the packers have to stop to get a special size shipping protector because a bottle will not fit with the standard size shipping protectors, then the cost of operation increases.

To attempt to address this issue, historically over time, wine shipping protectors have had their geometries hollowed out or opened up to provide greater bottle size flexibility. But in taking these steps, the protection or capture performance of the shipping protection provided is compromised, subjecting smaller diameter and shorter bottles to excessive movement during shipment, leading to label and/or capsule abrasion.

A further disadvantage to standard plastic shipping protectors, especially expanded foams, is that they are less environmentally friendly as compared to shipping protectors of molded fiber, which are typically made from recycled paper and themselves can be recycled into reclaimed waste paper stock. The plastic and foam type shipping protectors are manufactured from non-renewable resources, i.e. petroleum, are difficult to recycle and do not easily biodegrade. Therefore, a growing trend is toward use of recycled and recyclable materials for shipping protectors, such as molded fiber.

Another type of shipping protector is the fold up corrugated shipping protector, which is supplied flat and is "assembled" by folding to a configuration adapted to insert a bottle therein and designed to provide a degree of protection during shipping. The assembling is either done on the line of a packing operation or must be pre-assembled in quantities to be available during packing. The on line assembly requires time and raises repetitive motion injury concerns from the repeated assembly motion. On the other hand, if die cut corrugated pre-assembled shipping protector inserts are employed, the packaging cost is increased and ready-to-use packaging storage needs are increased.

To overcome some of the issues with the prior art, molded fiber shipping protectors have been developed, for example, those described in U.S. Pat. No. 6,820,743 by Western Pulp Products Co., the assignee of the present application.

In the past, considering the wine industry, there had been four bottle shapes which were predominantly used in 750 ml volume configurations, Riesling/hock style bottles, Chardonnay/Burgundy style bottles, champagne punt bottles, and Bordeaux style bottles. The Riesling/hock bottle has a more elongated neck and provides a relatively smooth transition from the body of the bottle through the neck. The Chardonnay/Burgundy bottle is of a slightly quicker transition between the body of the bottle and the neck portion so as to have a less elongated appearance than the Riesling/hock bottle. Also, the Riesling/hock bottle is typically somewhat taller than the Chardonnay/Burgundy style bottle. The Bordeaux bottle is substantially the same height as a Chardonnay/Burgundy bottle but rather than employing a relatively concave transition from the body of the bottle through the neck, it has a convex transition portion into a substantially cylindrical shaped neck. The Champagne bottle is a low shoulder profile (fat) bottle, with an indentation or punt in the bottom thereof.

But, in order to provide a distinguishing appearance to the product at the retail sales point, to differentiate the product from others on display, wineries are utilizing varied and unique shaped bottles. Such bottle variations typically involve making the bottle longer, more tapered or less tapered, or of larger diameter. Such varied shapes are less likely to fit or to be adequately secured in shipping protectors in accordance with the prior art, and are more inclined to move excessively back and forth, whether side-to-side or end-to-end (or rotationally) excessively during shipping. This excessive movement results in abrasion or scuffing of the bottle label and capsule. Since a factor in purchase of wine for many buyers is the aesthetic properties of the bottle and label, such abrasion makes the bottle less desirable to the consumer, collector or retailer, and may make it difficult to sell for full price.

Shippers of bottles, such as wine fulfillment operations, have speed and versatility requirements for any packaging systems. Having to employ multiple choices of shipping protectors in order to ship the variety of products is undesirable as it reduces the purchasing power of the user by having to maintain plural sets of shipping protector inventories, and, can reduce packing line throughput.

SUMMARY OF THE INVENTION

In accordance with the invention a bottle packaging system employs a shipping protector having a flexible flange portion that is adaptable to different bottle configurations, whereby when packed into a shipping carton, container or shrink wrapped, the shipping protector and packaging system interact to engage the bottles therein to minimize bottle movement during shipping, thereby avoiding damage to the bottle, label and capsule.

Accordingly, it is an object of the present invention to provide an improved bottle shipping system.

It is a further object of the present invention to provide an improved bottle shipping protector that is adaptable to receive a wide variation of bottle configurations.

It is yet another object of the present invention to provide an improved bottle shipping protector that captures a more diverse variety of bottle configurations in such a manner as to minimize movement of the bottle relative to the shipping protector during shipment.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 17A is a view illustrating a bottle between a pair of shipping protectors with the shipping protectors cut as in FIG. 15, with a different shape bottle, while

DETAILED DESCRIPTION

The system according to a preferred embodiment of the present invention comprises a molded fiber shipping protector having bottle receiving portions adapted to receive a variety of bottle shapes therewithin, including a flange member adapted for flexible displacement to engage certain bottle configurations.

Figure 1:
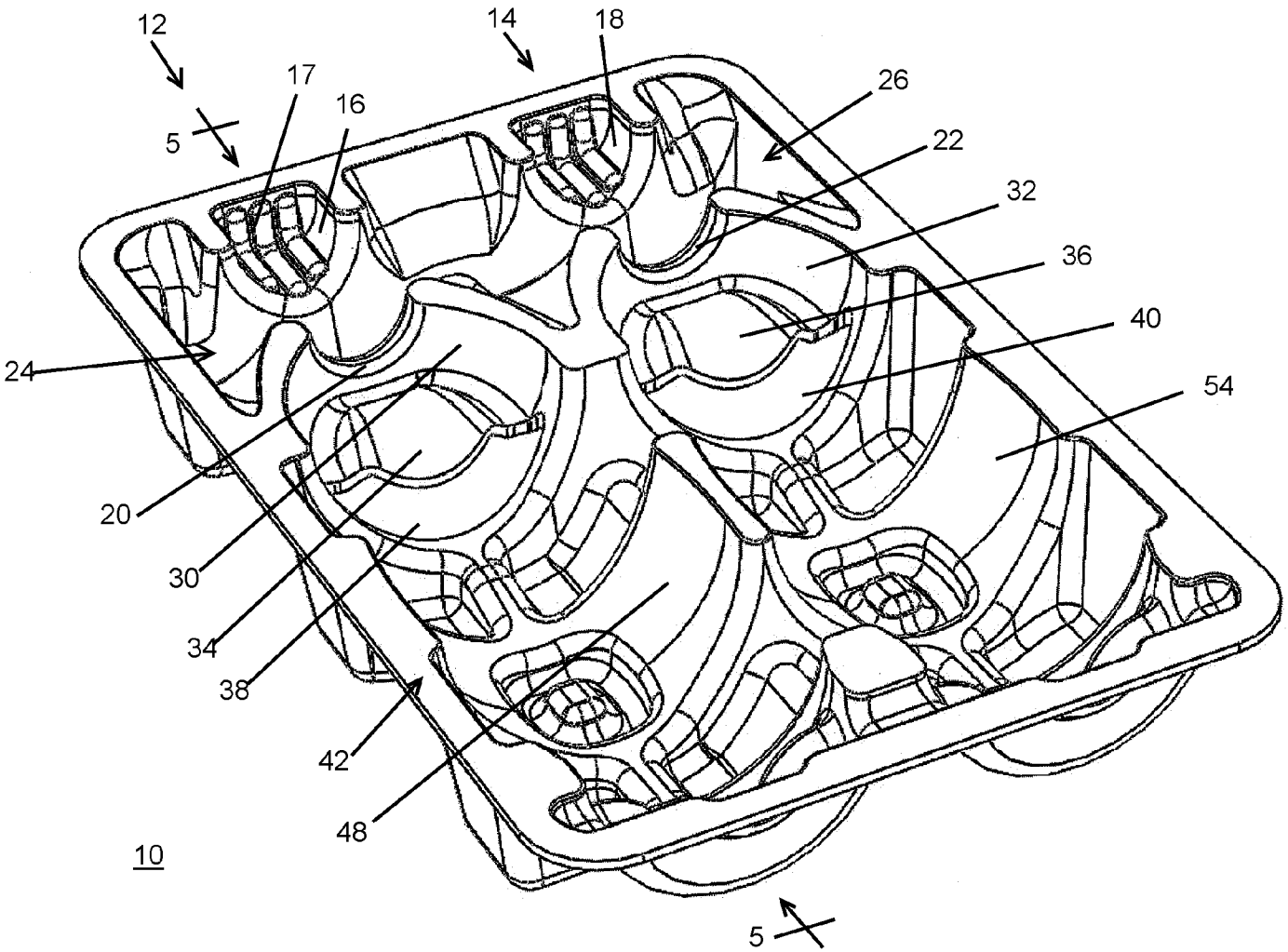
FIG. 1 is a perspective view of a bottle shipping protector in accordance with the invention.
Figure 2A:
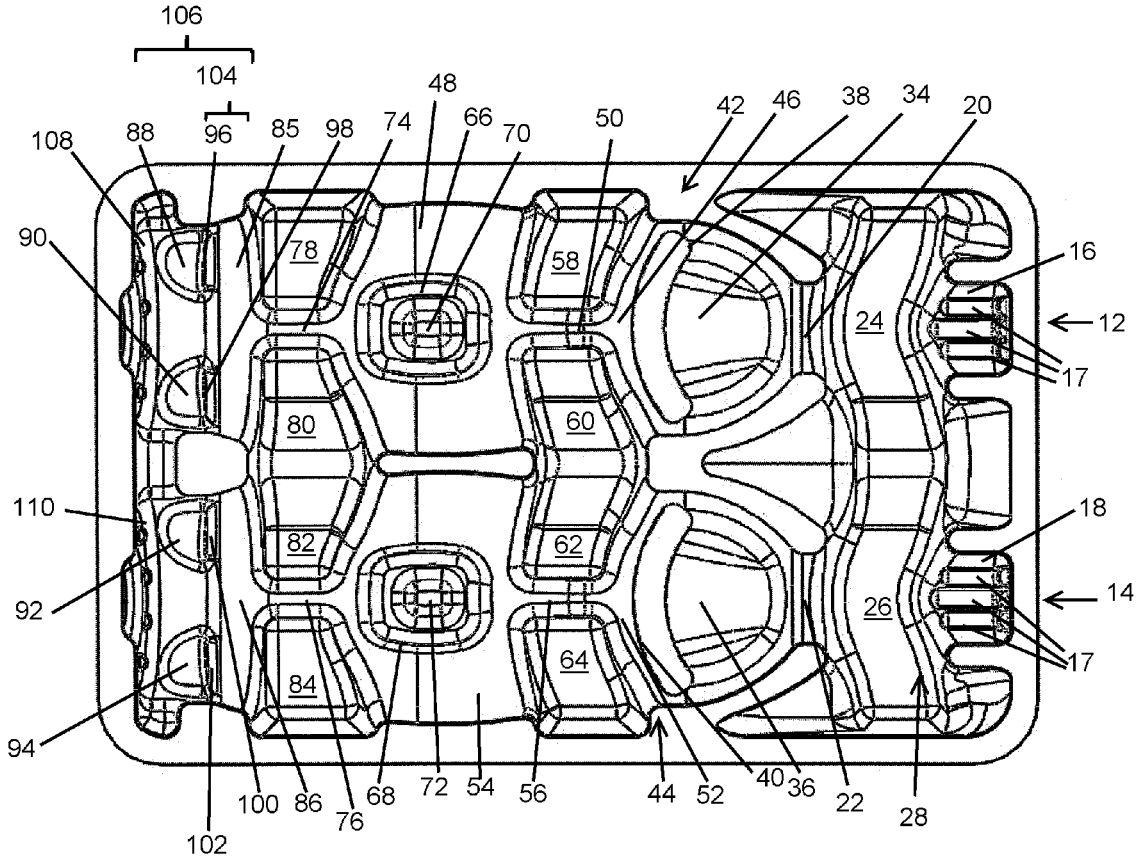
FIG. 2A is a top view of the shipping protector of FIG. 1.
Figure 2B:
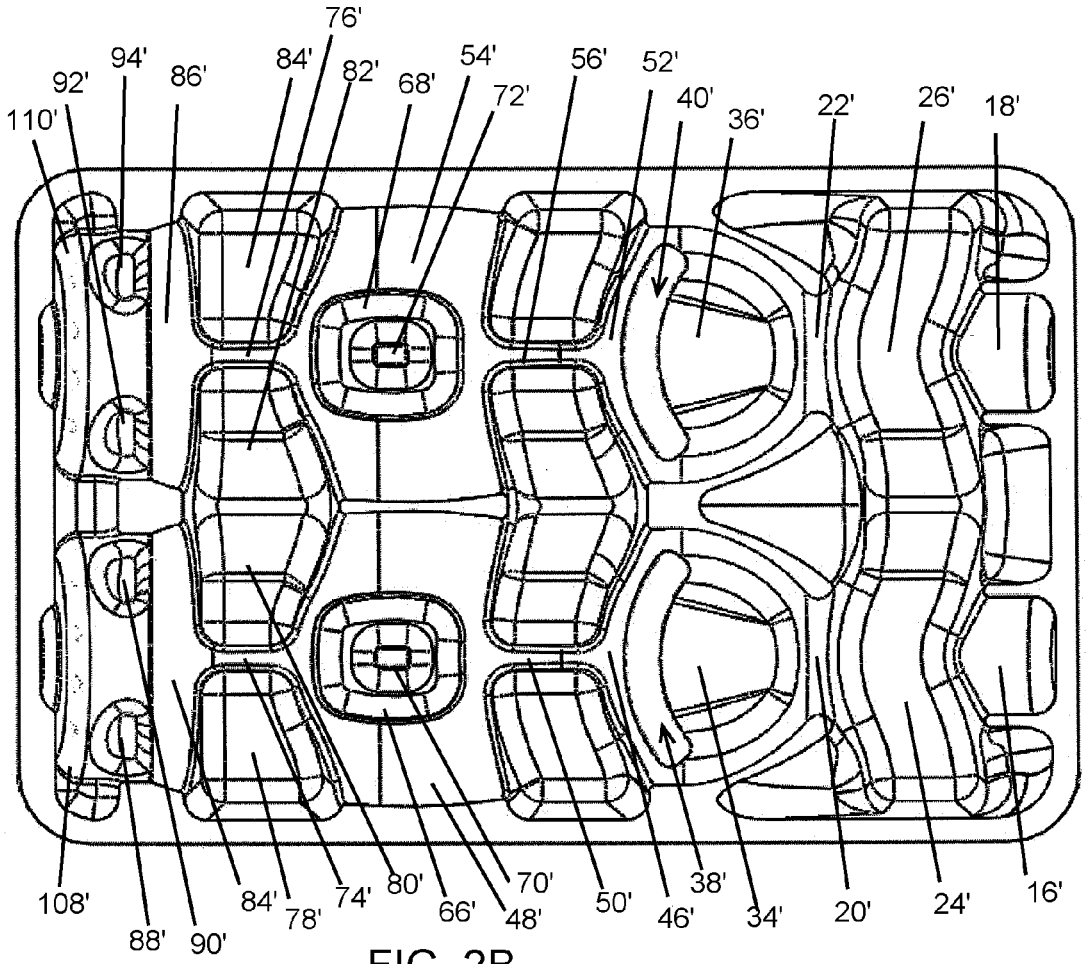
FIG. 2B is a bottom view of the shipping protector of FIG. 1.
Figure 3:
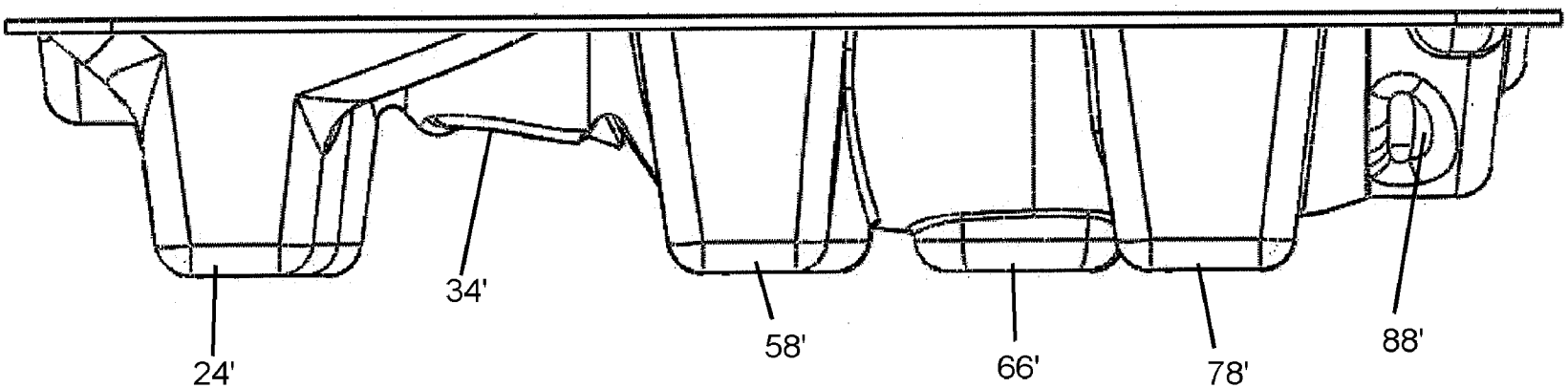
FIG. 3 is a side view of the shipping protector of FIG. 1.

Referring to FIG. 1, a perspective view of a bottle shipping protector 10 in accordance with the invention, and FIG. 2A and FIG. 2B, top and bottom views thereof, the shipping protector as illustrated is substantially rectangular in overall configuration and includes 2 bottle receiving bays 12, 14 adapted to receive a bottle in each bay in a horizontal orientation. Each bay has a bottle capsule receiving zone 16, 18 designed for the top end of the bottle to be placed therein or close thereto. The capsule receiving zones may include with plural raised ridge members 17 to provide smaller surface areas of contact with the top end of the bottle. A neck receiver zone 20, 22 is defined in each bay spaced from the capsule receiving zones by a gap portion provided by a well 24, 26 defined in the shipping protector, giving an open area between the neck and capsule receiving zones. The walls of the shipping protector are provided in a wave-like shape in this region such that the shape of the wall edges conforms to the shape of line 28. The floors of the wells 24, 26 are substantially flat, defining foot members 24', 26' for the shipping protector on the opposite face of the shipping protector from the well floors.

The bottle receiving zones now widen with arcuate shape walls 30, 32 to define bottle shoulder receiving zones. The bottom of the shipping protector in these zones is provided with flexible or yieldable support flange portions 34, 36 having openings or slots 38, 40 at one peripheral edge of the flange portions, the openings suitably providing some of the flexibility to the flange portion by the presence of the opening enabling the flange portion to flex or rebound in a non-destructive manner. The openings or slots 38, 40 are suitably defined as holes through the body of the shipping protector. The "horizontal" surfaces of the flange portions are curved to define a somewhat relaxed "M" shape in the illustrated embodiment, although other shapes or configurations may be employed. The opposing wall of the shipping protector on the opposite side of the openings 38, 40 is arcuate in shape. The shipping protector defines a bottle mid-region engaging area 42, 44 here, which suitably has forward arcuate members 46, 52 and rearward arcuate members 48, 54 defining somewhat semicircular shapes connected by longitudinal central ridge members 50, 56. The rearward member 48, 54 define receiving portions typically having the bottle main body portion positioned adjacent thereto. Between members 48, 54 and 46, 52, the shipping protector walls extend down to define wells 58, 60, 62 and 64, having substantially flat floors, defining therein foot member 58', 60', 62' and 64' on the opposite face of the shipping protector relative to the floors.

Centrally of the portions 48, 54, at substantially the bottom of the arcuate or semicircular shape thereof, well members 66, 68 extend downwardly to define shipping protector foot members 66', 68' on the opposite face of the shipping protector. In the illustrated embodiment, the well members have a substantially rectangular shape with curved perimeter edges, and a central upward extending portion 70, 72.

Longitudinal central ridge members 74, 76 connect semicircular bottle bottom end receiving member 85, 86, with wells 78, 80, 82 and 84 defined in the shipping protector adjacent the ridge members 74, 76 to provide feet portions 78', 80' and 82' on the opposite face of the shipping protector. Approximately centrally of the bottle end receiving members are bottle end stop member 88, 90, 92 and 94, two such members being provided in each bay 12, 14. Each stop member has a flat face portion 96, 98, 100, 102 adapted for engagement by a bottom portion of a bottle. Further, the end stop members are adapted to be deformed so as to crush or flatten down, to extend the depth of the bottle end receiving members, providing a variable depth, short depth 104 and longer depth 106 (FIG. 2A) for accommodation of different bottle lengths. At the end of the bottle end members, back face 108, 110 provides a substantially flat surface to interact with bottle bottoms of the longer bottle configurations, with plural (4 in the illustrated embodiment, spaced radially about the faces 108, 110) vertically aligned ridges 111 providing increased rigidity to the back face and spacing of the bottle bottom slightly away from the face.

Figure 6:
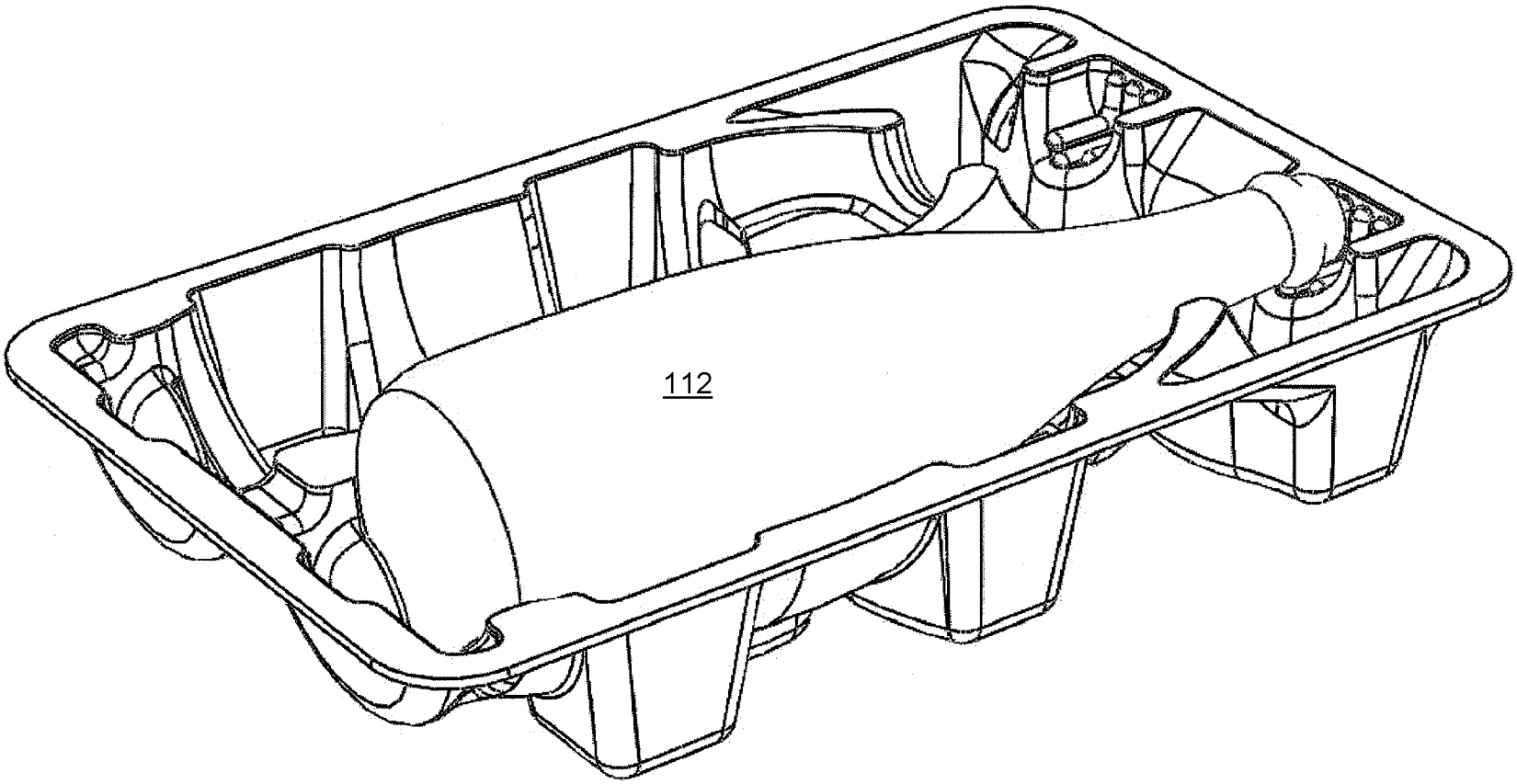
FIG. 6 is a perspective view of the shipping protector of FIG. 1 with a bottle positioned therein.
Figure 7:
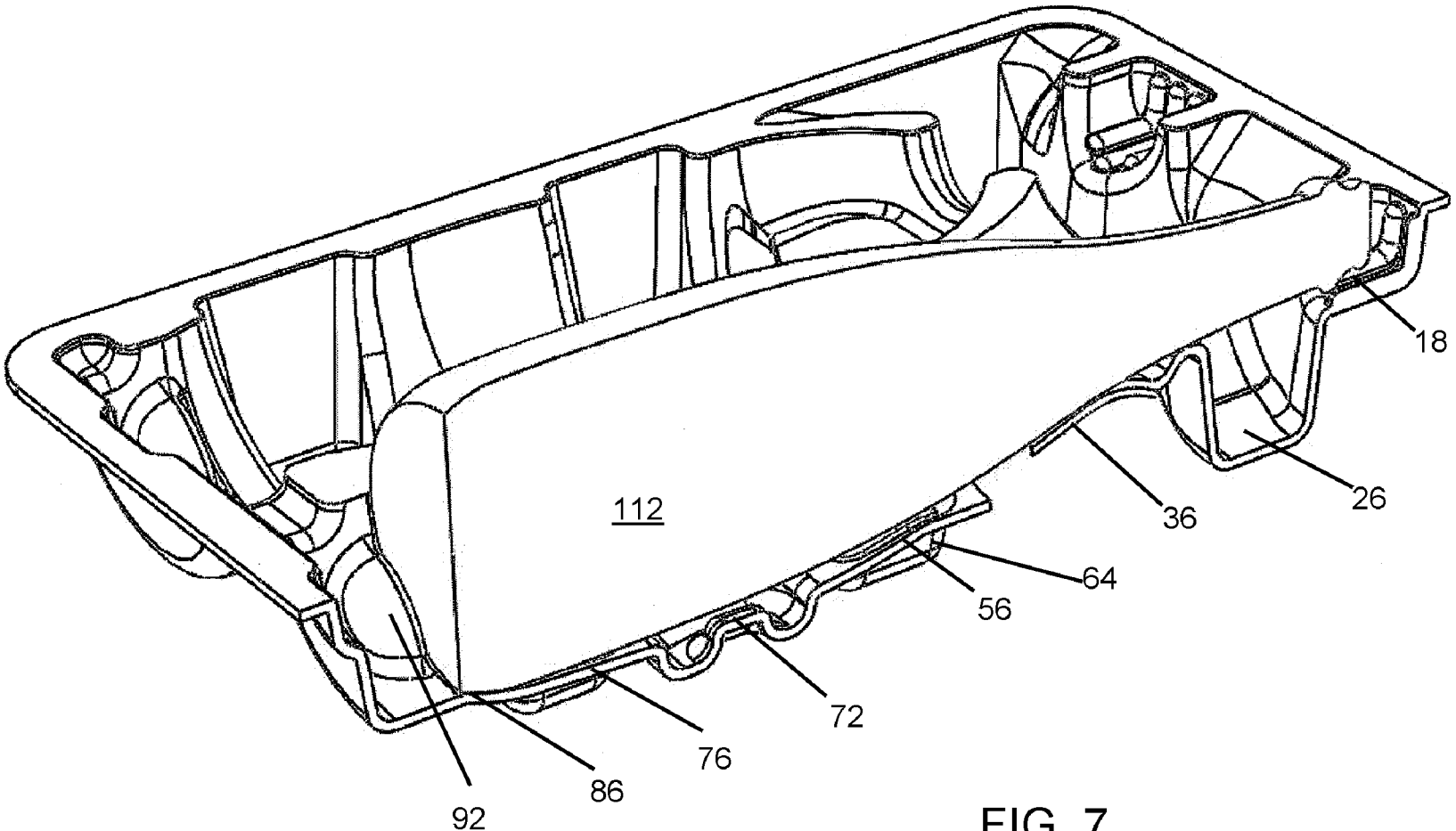
FIG. 7 is a cut-away perspective view of the shipping protector of FIG. 6.
Figure 8:
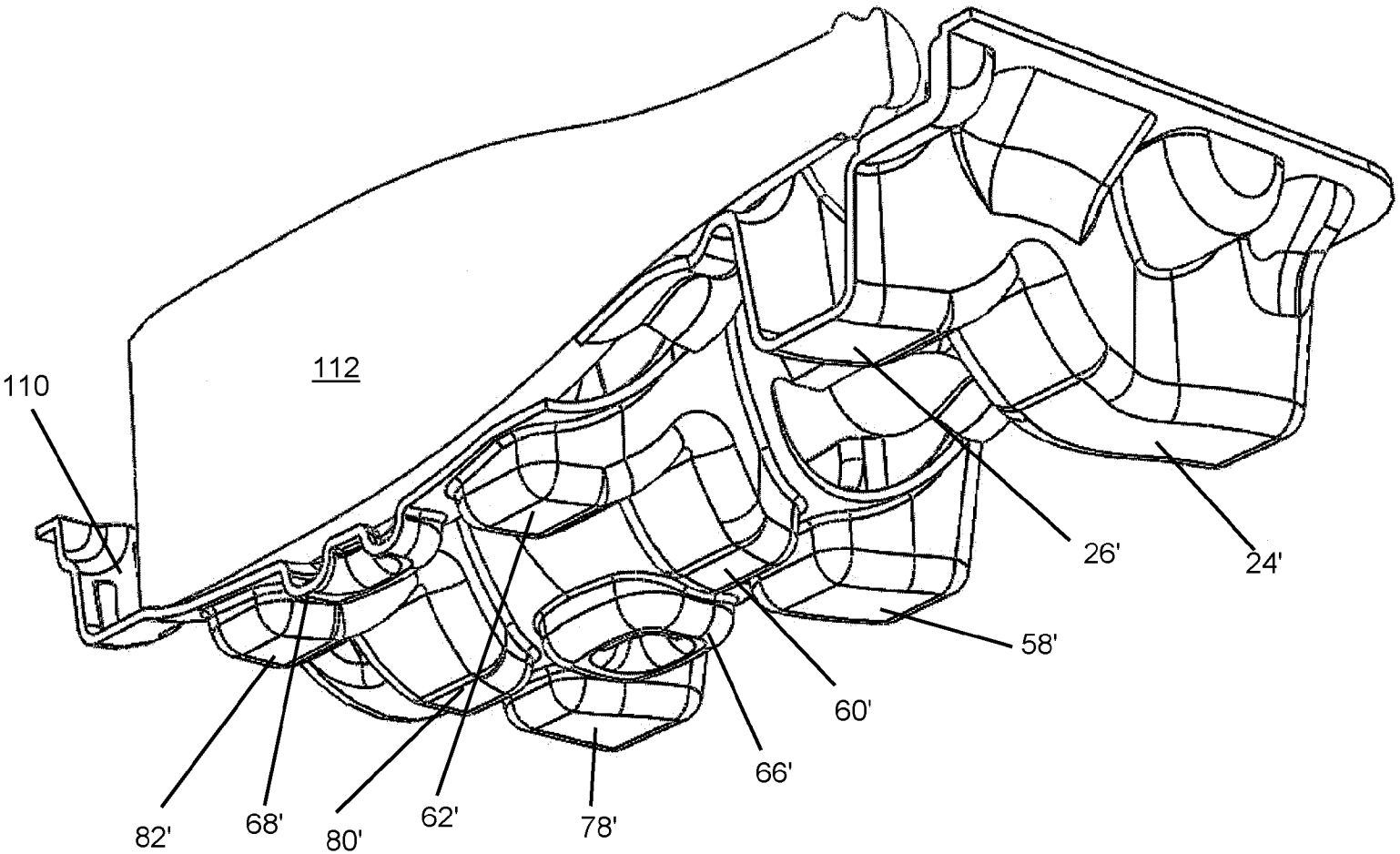
FIG. 8 is another cut-away perspective view of the shipping protector of FIG. 6, viewed from below the shipping protector looking up.

Referring now to FIGS. 6-8, which are perspective and cut-away perspective views of a shipping protector with a champagne or punt style bottle 112 placed therein. For this particular bottle shape, the capsule rests against receiving zone 18, while the neck receiver zone 22 does not quite meet the bottle neck. Flexible flange 36 is engaged with a portion of the lower neck of the bottle. Central ridge members 56 and 76 substantially meet the bottle body (as does the rest of the semicircular bottle receiving portions therebetween). With the illustrated bottle configuration, the bottle end stop members 92, 94 do not quite touch the bottle bottom. However, a slightly longer champagne bottle would be engaged by the stop members.

As noted above, for longer bottles, stop members 88, 90, 92, or 94 may be deformed so as to be pushed into the depth plane of the shipping protector out of the way so that the bottle has further room to extend toward the back face 110.

In use for shipping, a bottle is placed within the shipping protector receiving portions, a second shipping protector is placed on top of the first shipping protector in a paired or mated type configuration, and the shipping protectors are placed in a shipping carton. One or more layers of such shipping protector/bottle/shipping protector configurations may be placed into the shipping carton, whereupon the shipping carton lids are closed and the shipping carton is sealed (e.g., by taping). The interaction of the shipping carton with the shipping protectors results in bias of the shipping protectors to the bottle, whereby the various shapes and portions of the shipping protectors secure the bottle's position. In particular, the flexible flange portions 34, 36 will, for most bottle configurations, provide a biased engagement to the bottle neck region, helping to secure the bottle against movement relative to the shipping protector. Openings or slots 38, 40, provide a release zone or collapse region for flange portions 34, 36, resulting from the gap or non-formed openings at one peripheral edge of the flange portions, the openings suitably providing some of the flexibility to the flange by the presence of the opening enabling the flange portions to flex. Alternatively, openings 38, 40 could comprise weaker or thinner material than the flange portions, or more flexible material, to impart the ability to flex to the flange portions 34, 36, or, the edges of the flange portions could be perforated or tear-by-design to allow the flange to be moved out of position to accommodate larger diameter bottles. The desire of the flange to return to its original state creates tension against the bottle geometry for engagement against the bottle, while the container ensures biasing of the shipping protectors to the bottle. The configuration and operation of the flange helps to hold smaller diameter bottles in place, but, is adaptable to be moved out of the way to accept larger diameter bottles. While a corrugated shipping carton is a preferred shipping container, other containers or containment methods can be employed. For example, the shipping protector/bottle/shipping protector configuration could be shrink wrapped in the packing phase, to keep the shipping protectors biased relative to the bottles.

The shipping protector portions are each provided as separate pieces in the preferred embodiment, but can be manufactured to be hingedly paired together in a "clamshell" configuration if desired for a particular use.

Molded fiber articles, as a result of some manufacturing processes, may have a "smooth" finish face that was against the mold during forming and a somewhat rougher surface finish opposite face. In the preferred embodiment, the "smooth" face of the shipping protector is the face that engages the bottle in order to minimize abrasion from shipping protector/bottle interaction. Other processes can produce molded fiber article with "smooth" finishes on both faces.

The shipping protectors in the preferred embodiment are designed such that two bottles are received in side by side orientation, with both bottles oriented in the same top to bottom direction. This orientation allows for quick placement of bottles in the shipping protectors during packing. Other versions, however, can have the bottles in staggered positions and with alternating top/bottom orientations.

Figure 9:
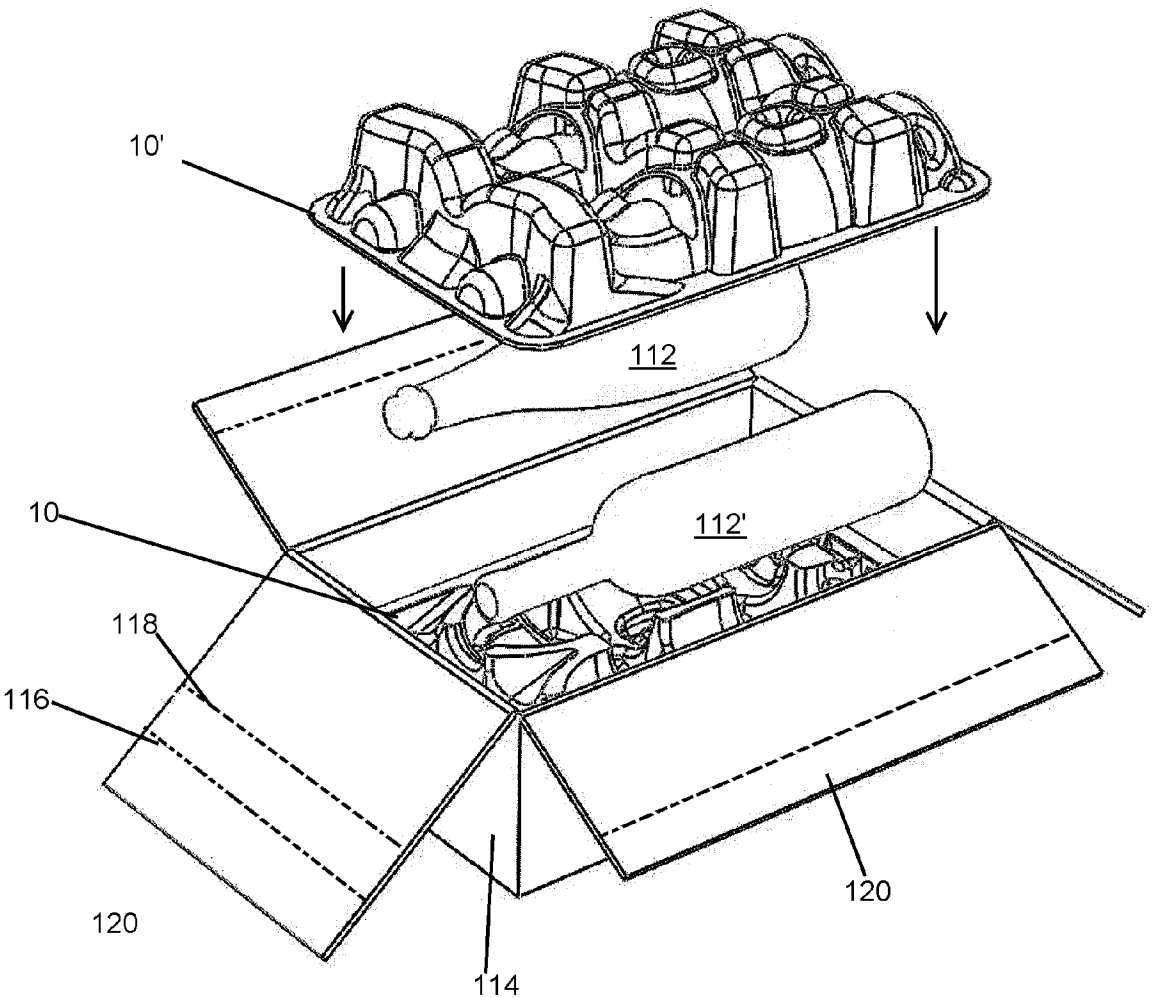
FIG. 9 is a view of the shipping protector configuration in a shipping carton, illustrating the interaction of the elements thereof.

FIG. 9 illustrates a corrugated shipping carton and shipping protector packaging configuration, wherein two shipping protectors 10, 10' surround bottle 112 in a paired or mated configuration, wherein the two shipping protectors face each other with the bottle positioned in the respective bottle bays, and the shipping carton 114 receives the shipping protectors therein. The shipping carton is closed and provides a close fit to the shipping protectors so as to sustain the bias of the flexible flange portions of the shipping protectors to the bottles.

The shipping carton can be provided with a multi-scored top portion with score lines 116, 118 being provided on the shipping carton flaps 120, to enable larger diameter bottles to be shipped, wherein the two paired shipping protector portions, when positioned against the bottle, have a gap defined therebetween, as a result of the larger bottle diameter preventing the shipping protectors from touching face to face. The resulting stack of shipping protector, bottle, shipping protector causes a larger overall height of the package, and, by folding the shipping carton flaps 120 on the different score lines 116 or 118 rather than the default hinge line of the flap, the overall shipping carton height may be increased, such that a single shipping carton type can accommodate a wider variety of bottle sizes.

In a preferred embodiment, the diameter of bottle that is accommodated while still having the upper and lower shipping protector faces contacting is 3.82 inches. However, the shipping protectors will accommodate even larger diameter bottles, with the spacing gap between the facing shipping protectors as noted above.

Figure 4:
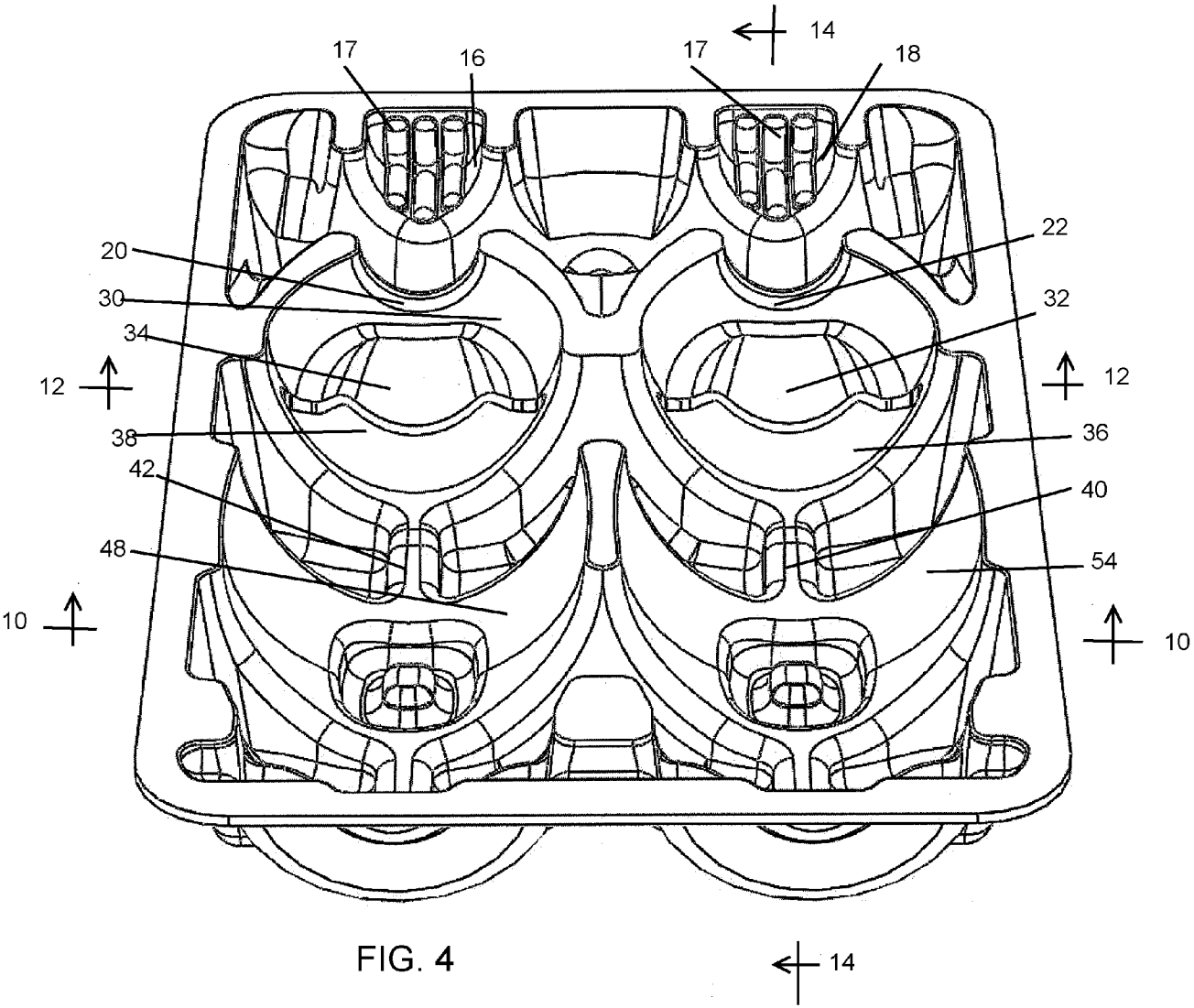
FIG. 4 is an end perspective view of the shipping protector of FIG. 1.
Figure 5:
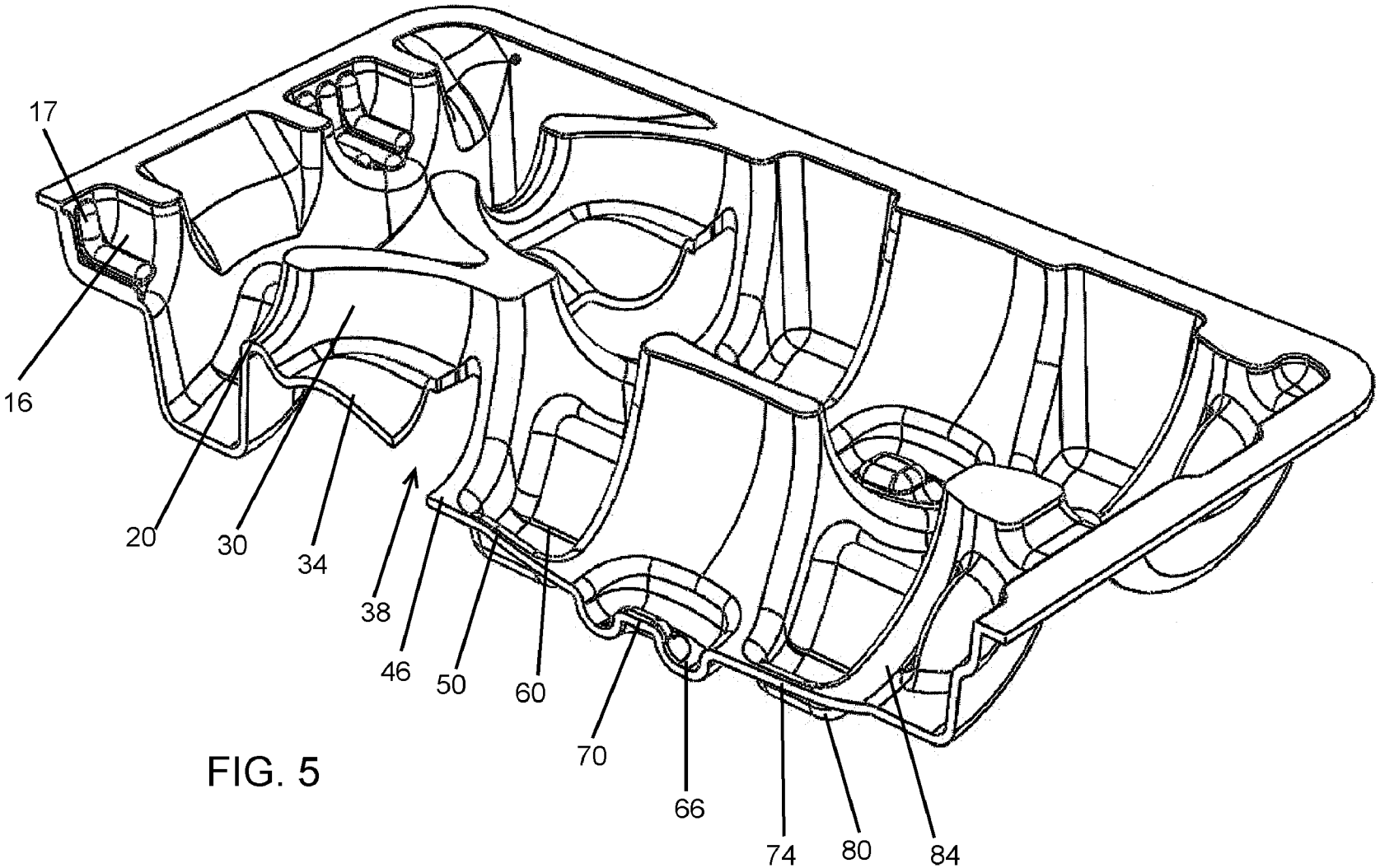
FIG. 5 is a cut-away perspective view of the shipping protector of FIG. 1 along line 5-5.
Figure 10:
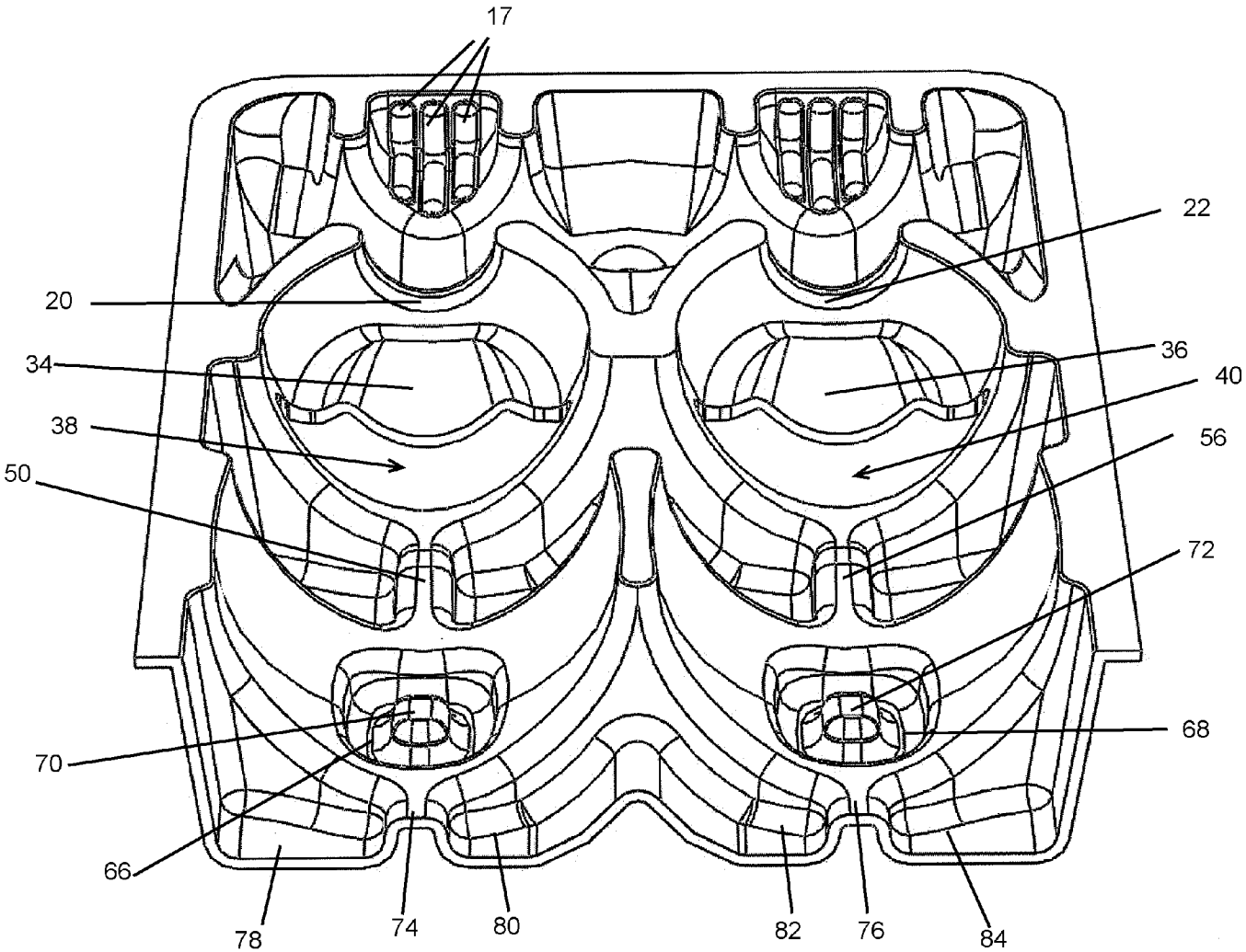
FIG. 10 is an end perspective view of the shipping protector cut along line 10-10 of FIG. 4.
Figure 11:
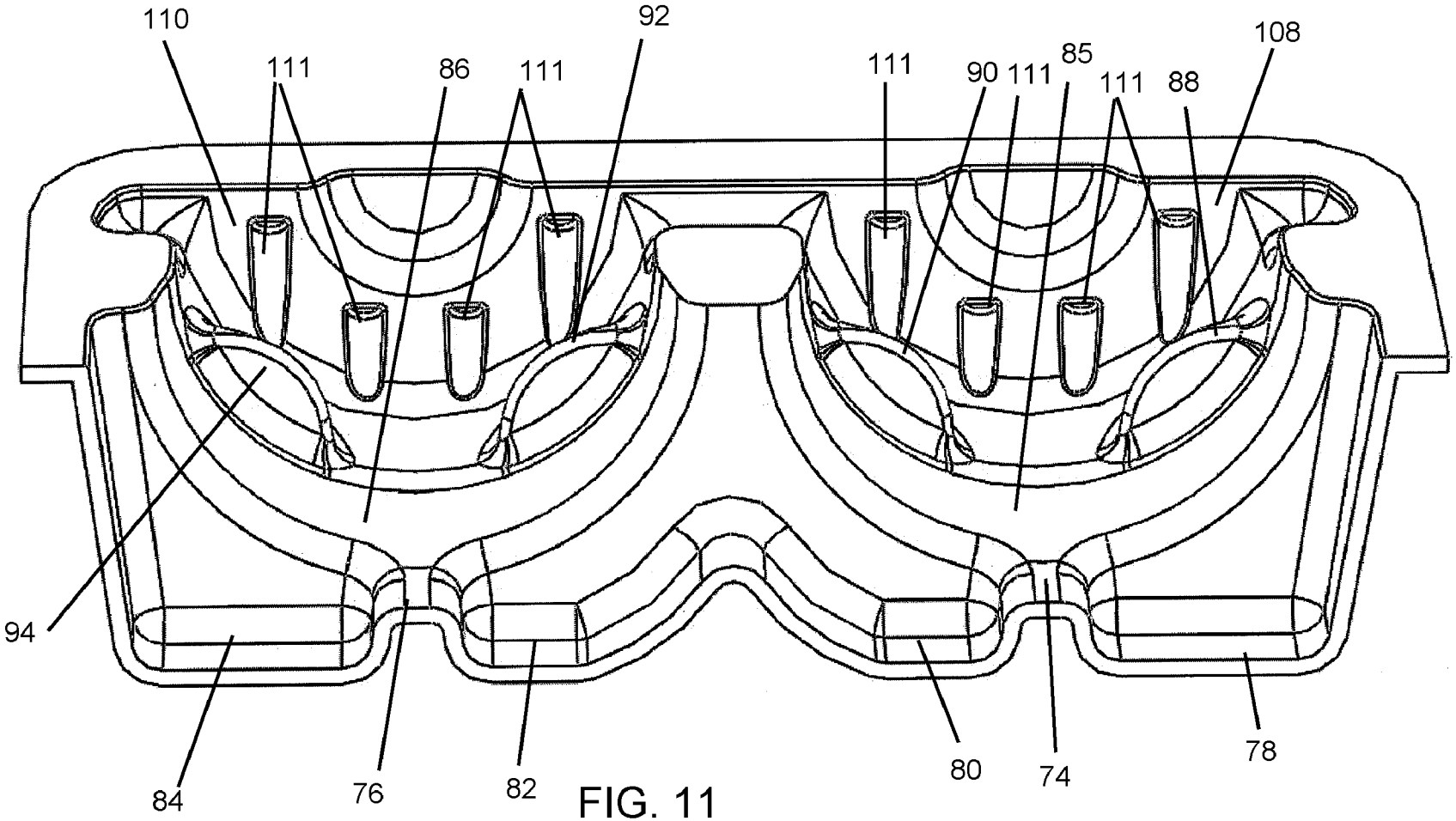
FIG. 11 is a view in the opposite direction of the cut away portion of FIG. 10.
Figure 12:
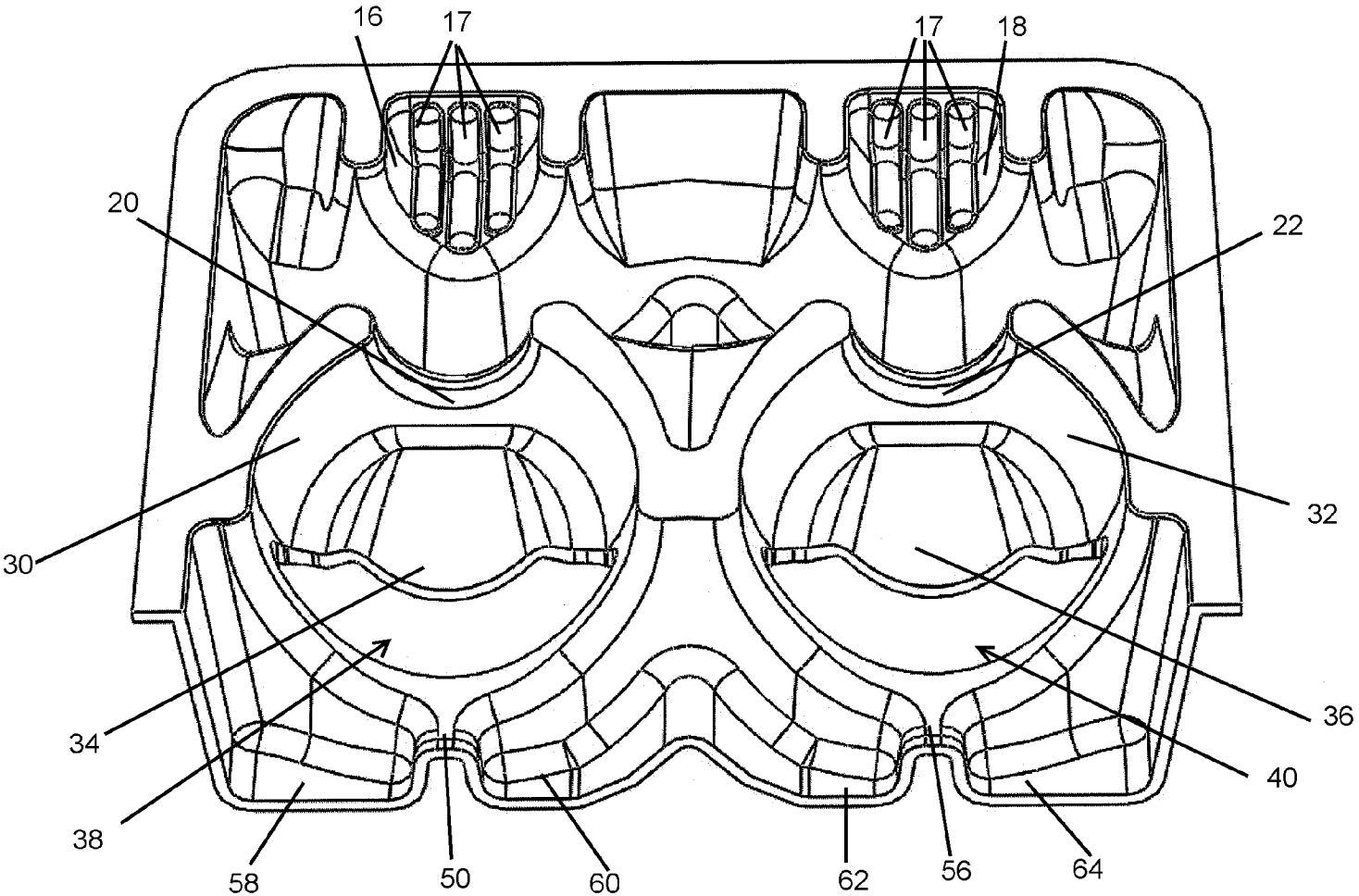
FIG. 12 is a cut away view taken along line 12-12 of FIG. 4.
Figure 13:
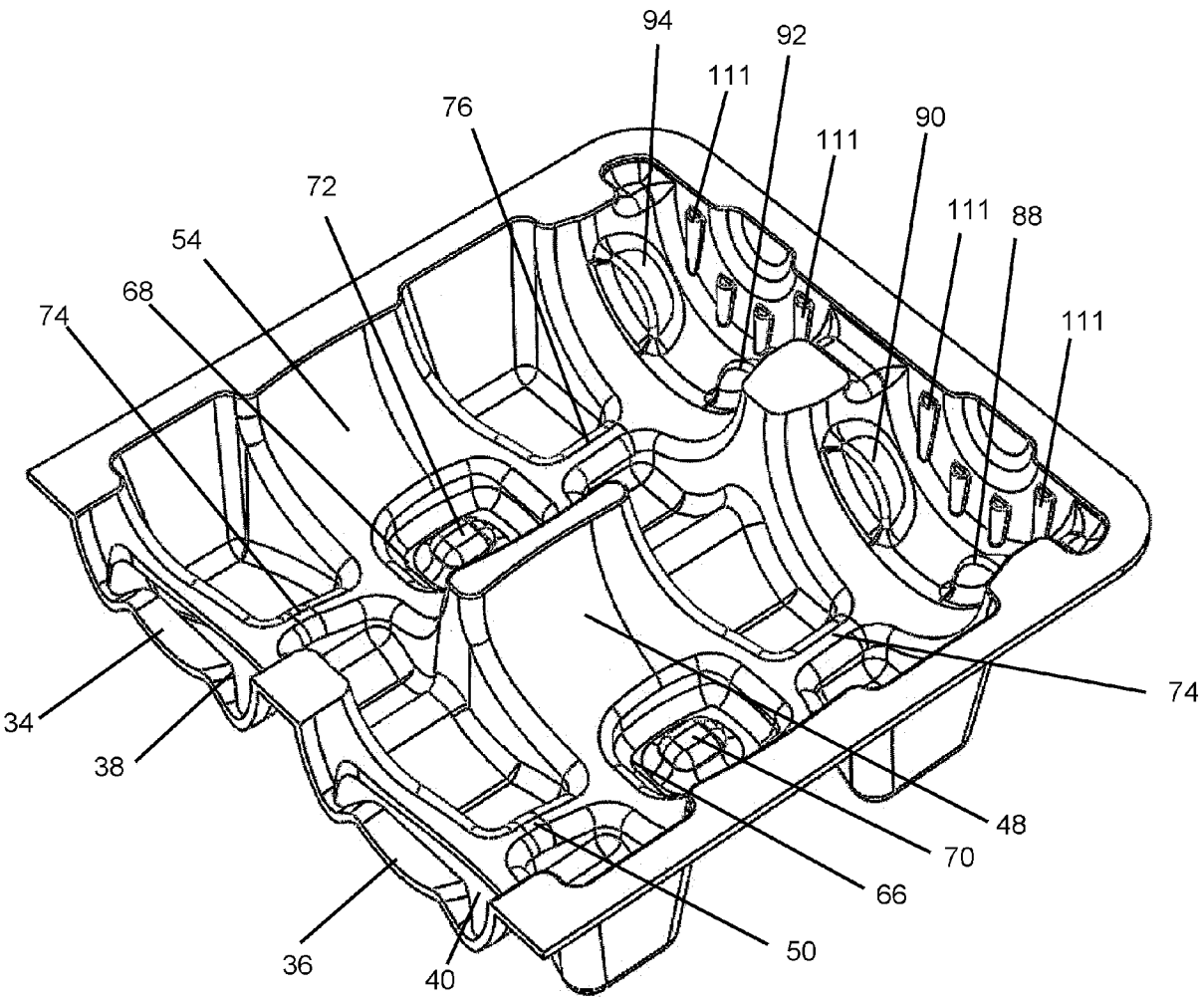
FIG. 13 is a view in the opposite direction of the cut away portion of FIG. 12.
Figure 14:
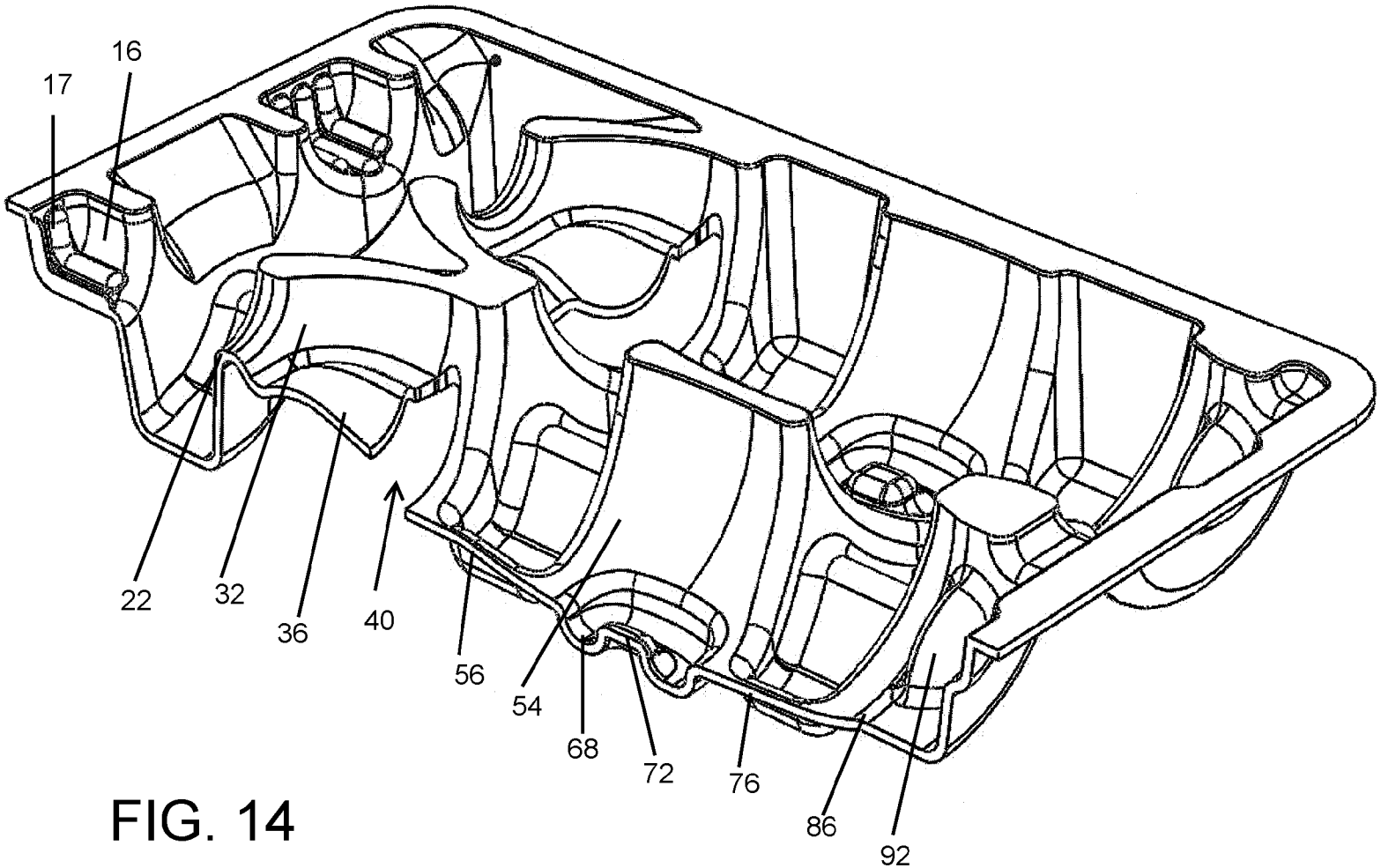
FIG. 14 is a cut away view taken along line 14-14 of FIG. 4.

FIGS. 10-16 provide cut-away views at various positions of the shipping protector for further illustration of the configuration thereof, wherein FIG. 10 is an end perspective view of the shipping protector cut along line 10-10 of FIG. 4 and FIG. 11 is a view in the opposite direction, showing bottle end stop members. FIG. 12 provides a cut away view taken along line 12-12 of FIG. 4, showing the top-of-bottle receiving end, FIG. 13 being the view of the opposite direction, showing the bottom-of-bottle receiving end. FIG. 14 shows a cut view along line 14-14 of FIG. 4, showing a transverse view of one bottle receiving cavity, with FIG. 15 providing the view in the opposite direction.

Figure 15:
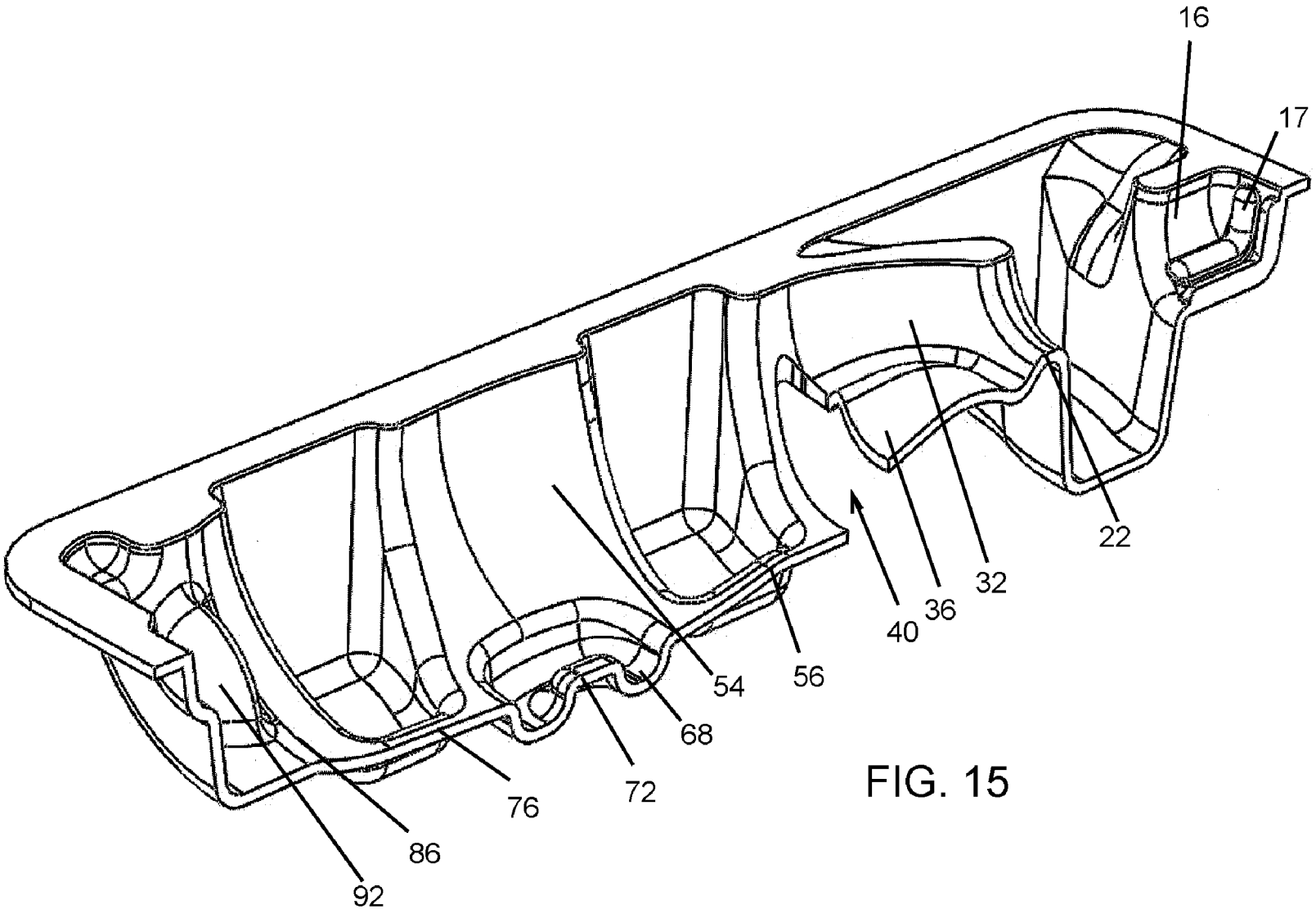
FIG. 15 is a view in the opposite direction of the cut away portion of FIG. 14.
Figure 16:
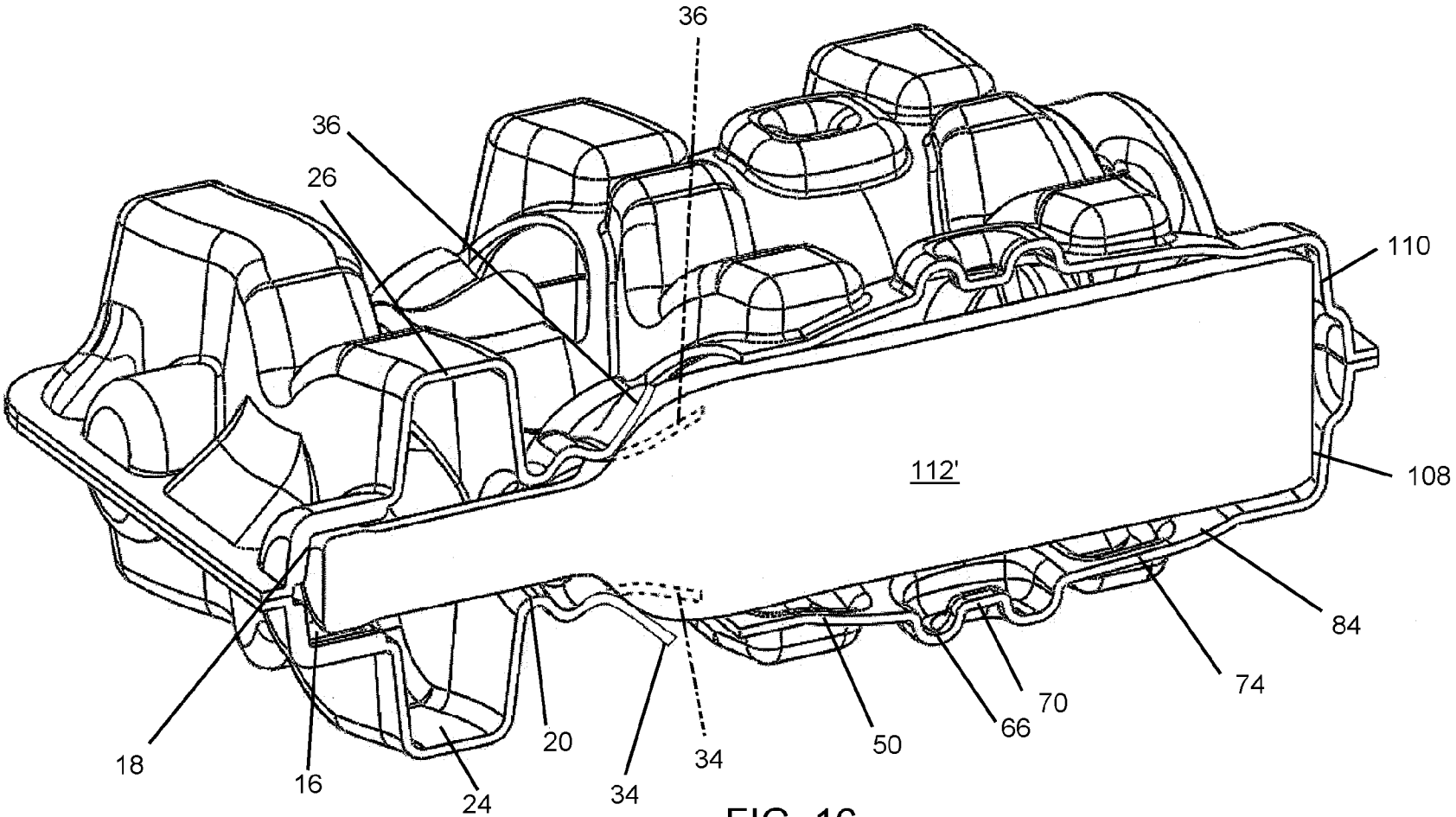
FIG. 16 is a view illustrating a bottle between a pair of shipping protectors with the shipping protectors cut as in FIG. 15.

FIG. 16 is a side view illustrating a bottle 112 between a pair of shipping protector portions 10/10' with the shipping protector cut as in FIG. 15. FIG. 17 provides the view of FIG. 16 without the bottle therein. In FIG. 16, it can be observed that the flexible support flange portions 34, 36 are engaged with the shoulder portion of the bottle 112, and are adapted to flex and move outwardly with respect to the bottle to accommodate the particular shape of the bottle. This provides a good engagement with the bottle to minimize movement of the bottle during shipping, and contacts the bottle in an area other than where labels would be present, to reduce scuffing or abrasion. Illustrated in phantom in FIG. 16 is the position the flange portions 34, 36 would be in if the bottle was not present. The bottle 112' is a longer bottle, wherein end stop members 88, 90, 92 and 94 have been pressed out of the way so as to accommodate the longer bottle.

Figure 17A:
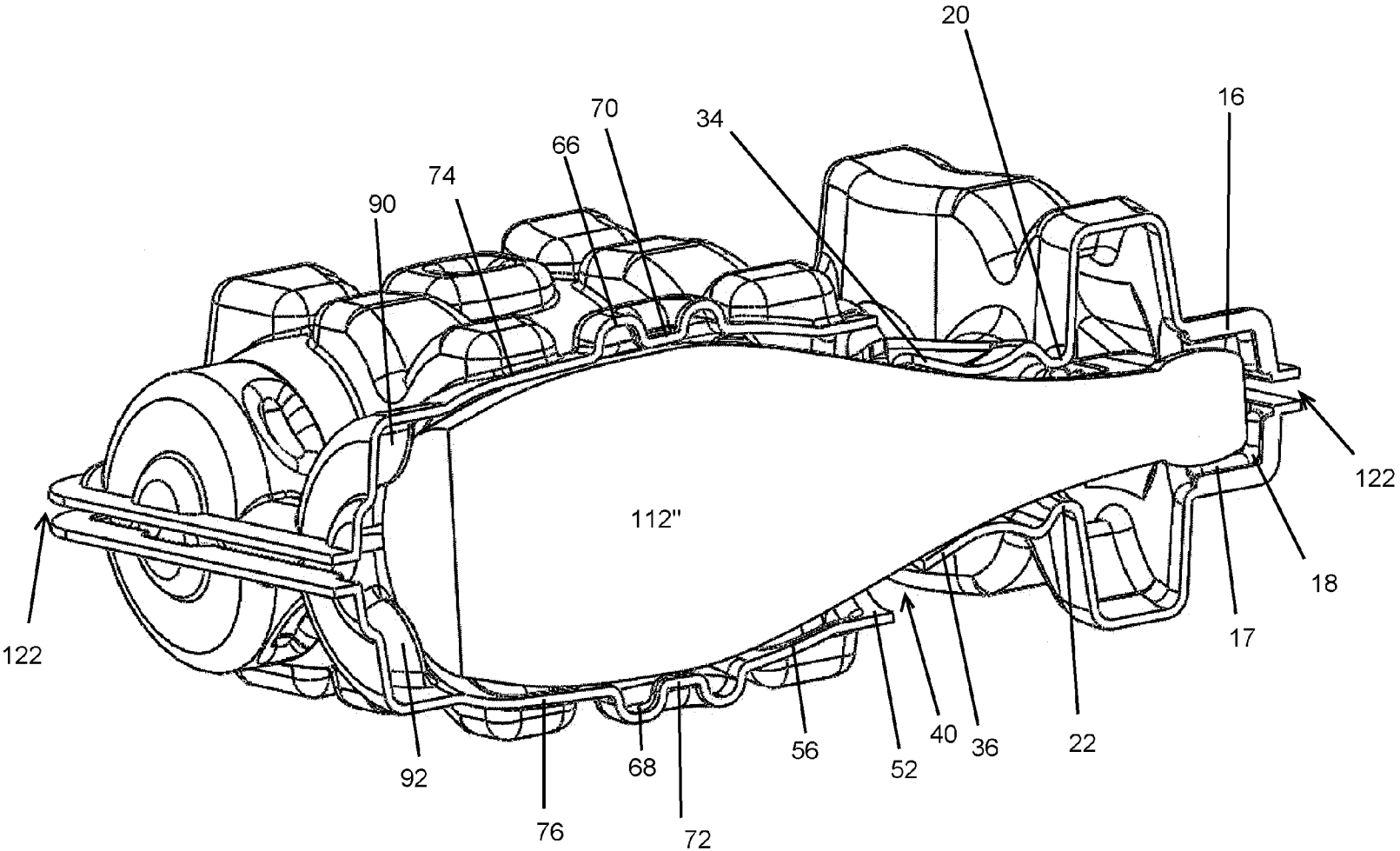
Figure 17B:
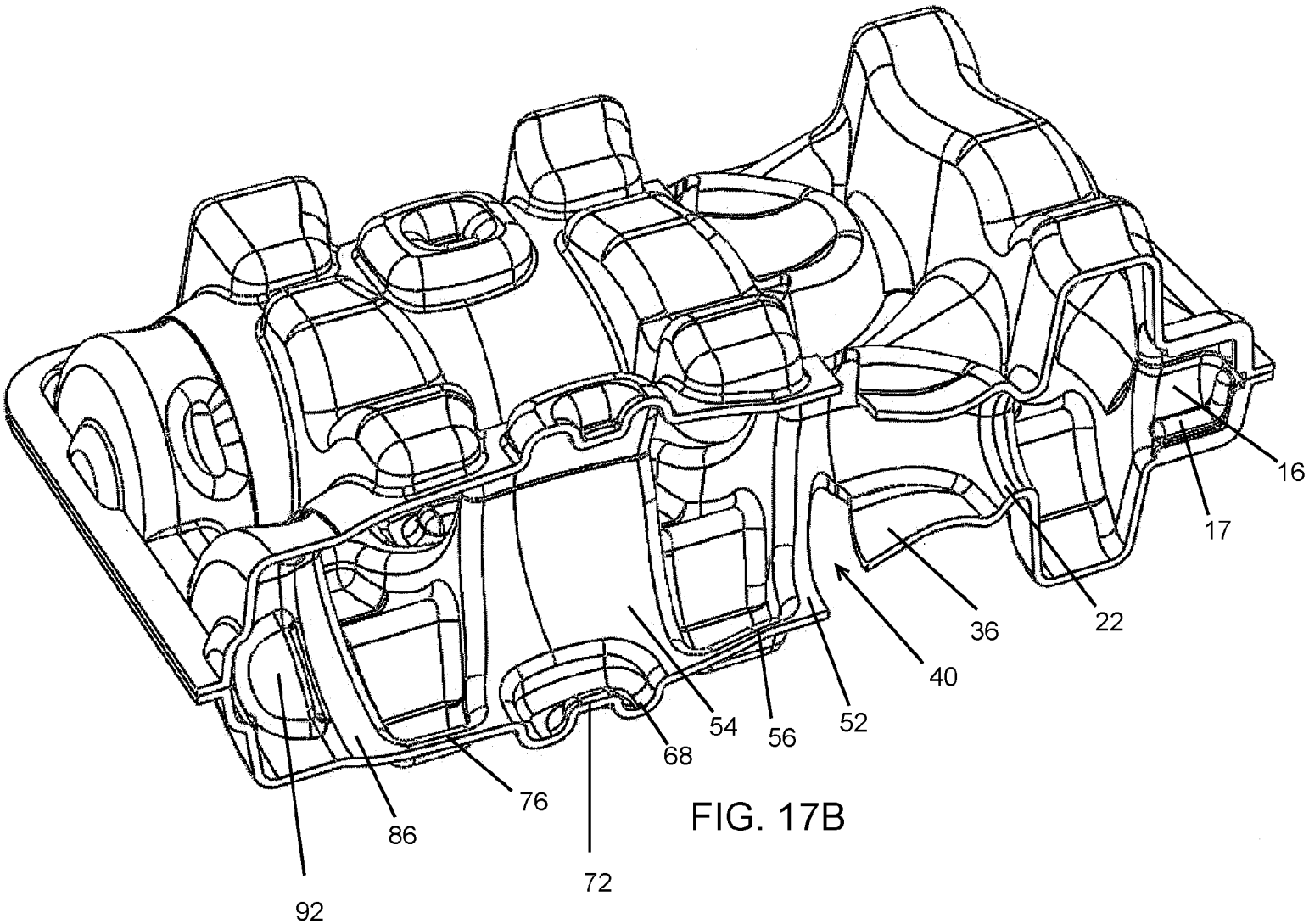
FIG. 17B is the view of FIG. 17A without the bottle therein.

FIG. 17A is a view illustrating a bottle 112", of a wider diameter and shorter length than the bottle 112' of FIG. 16. The bottle is between a pair of shipping protector portions with the shipping protector cut as in FIG. 15. In this configuration, since the bottle is shorter, end stop members 88, 90, 92 and 94 have not been pressed out of the way, to accommodate the shorter bottle. FIG. 17B is the view of FIG. 17A with the bottle removed, and with the view angle changed, for illustration purposes. In FIG. 17A, since the bottle is large diameter, a spacing gap 122 results, but the shipping protectors still suitably accommodate and protect the large diameter bottle.

Figure 18A:
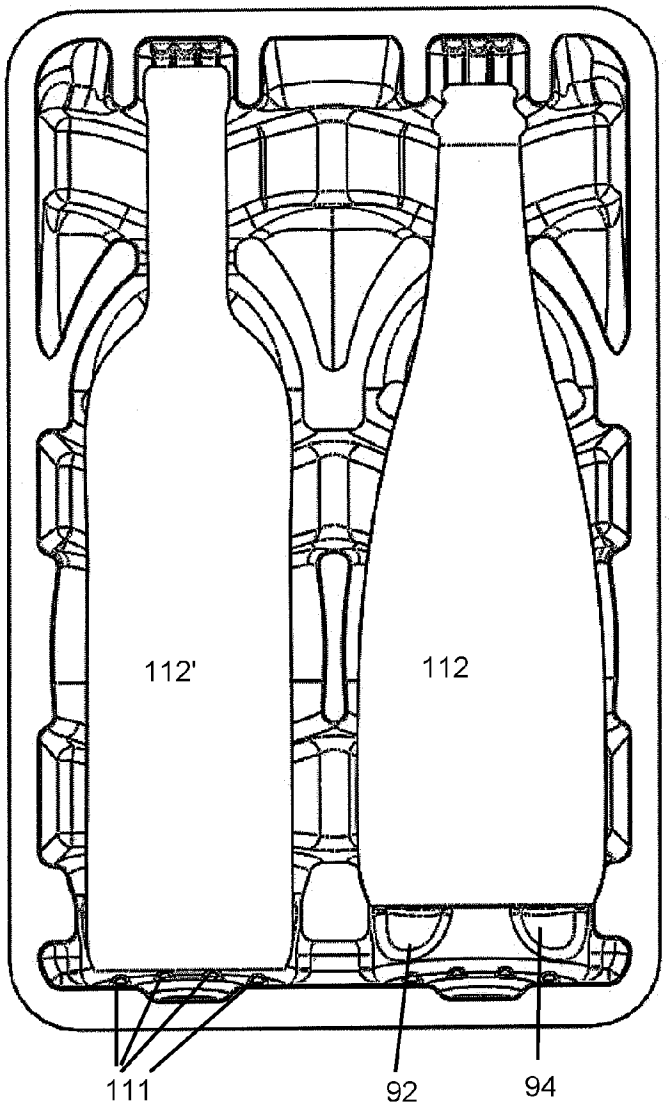
FIG. 18A and FIG. 18B are a top views of the bottle-bottom-engaging end of the shipping protector illustrating the interaction of the shipping protector portions with the bottom of a longer and shorter bottle, FIG. 18B being a closer view of the bottle end portions of the shipping protector to illustrate the interaction of the bottle bottoms with the shipping protector.
Figure 18B:
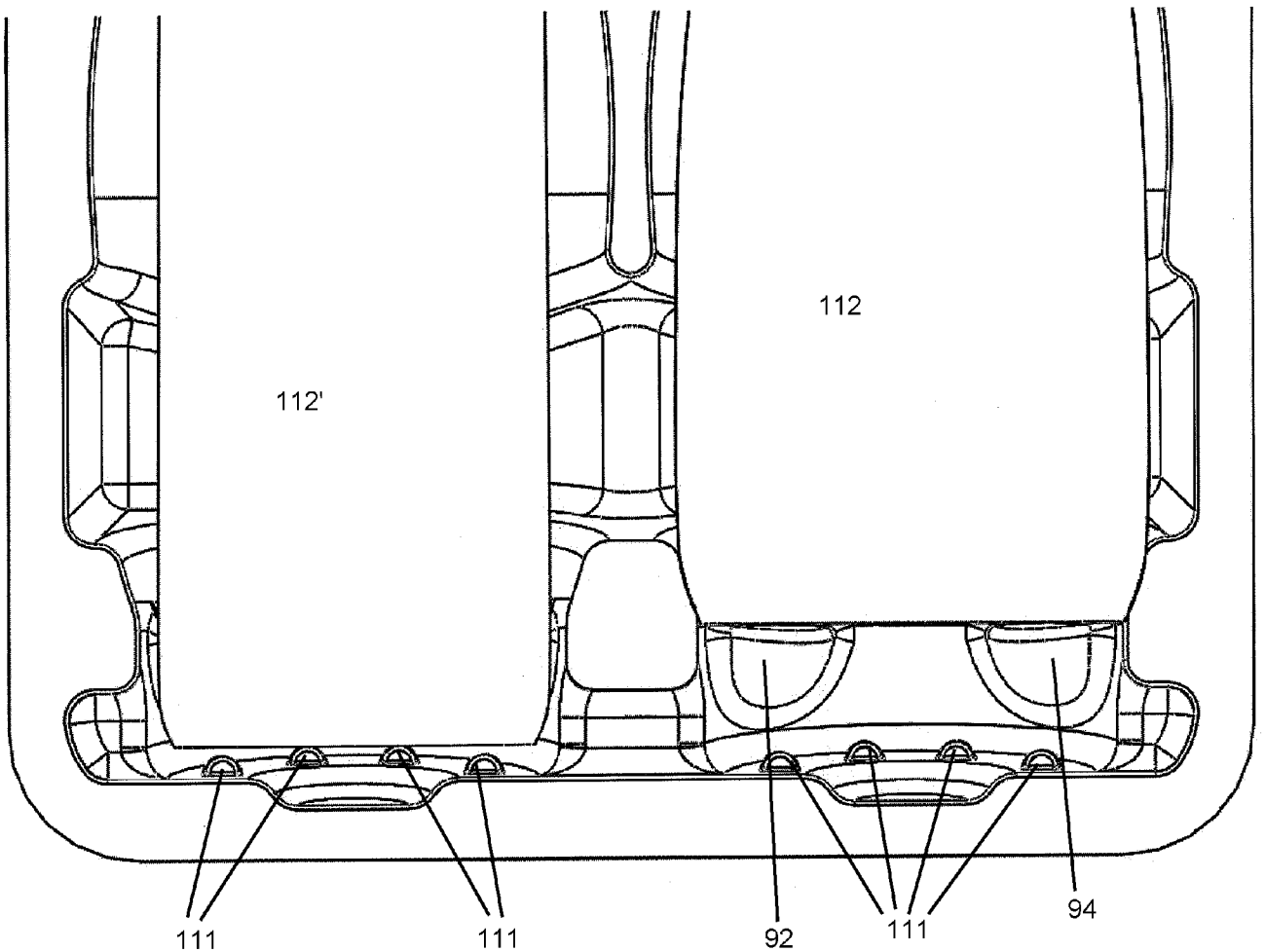

FIGS. 18A and 18B are a top views of the bottle-bottom-engaging end of the shipping protector illustrating the interaction of the shipping protector portions with the bottom of a longer and shorter bottle, FIG. 18B being a closer view of the bottle end portions of the shipping protector to illustrate the interaction of the bottle bottoms with the shipping protector. In FIG. 18A and FIG. 18B, the bottom of shorter bottle 112 interacts with bottle end stop members 92, 94, while longer bottle 112' interacts with members 111, as members 88, 90 have been pressed out of the way to provide a longer bottle receiving zone.

In the preferred embodiment of the shipping protector, the shipping protector is suitably made from molded fiber. A suitable shipping protector size is approximately 14.25 inches (36.2 cm) by 9 inches (22.9 cm), with a height of 2.5 inches (6.4 cm), although other dimensions may be employed.

While the preferred fiber is paper fiber, which may be recycled paper, newspaper, telephone books, corrugated cardboard, and short wood pulp fiber material, for example, other non-wood furnishes can be employed, such as leather, grass (e.g., miscanthus grass), rice hull material, cotton, kenaf, bagasse, hemp, flax, cotton, synthetic fibers, or other formable or moldable material. Further, a desired color may be provided to the shipping protector by use of dyes, pigments or other coloring agents.

In view of the description above, it will be appreciated that a shipping protector configuration, system and method are provided that enable a wide variety of bottle shapes and sizes to be accommodated with a single shipping protector element. This enables faster packaging and minimizes inventory of shipping components required. The shipping protector provides a smaller footprint when compared with the prior art, enabling smaller packaging sizes (and accordingly, savings on shipping container costs, and possibly on shipping charges), while accepting and protecting a broader variety of bottle sizes and shapes for shipment.

The shipping protector may be employed to ship a variety of bottled products, including wine, sparkling wine, culinary liquids (such as olive oil, vinegar), water (including mineral waters and sparkling waters), and the like, to name a few.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A shipping protection system, for protecting an article during shipping comprising:

a first receiving surface for removable placement against a first portion of the article;

a second receiving surface for removable placement against a second portion of the article;

wherein at least one of said first and second receiving surfaces comprises a yieldable support member adapted for flexible engagement with the article for adaptable engagement with a variety of shape and configuration of articles, wherein said article comprises a bottle, wherein said yieldable support member comprises a portion adapted for engagement with a portion of the bottle, said support member having a flexible portion adapted to flex in a direction away from the portion of the bottle in presence of biasing pressure, and wherein said flexible portion comprises a member having an edge defined adjacent an open portion, for enabling flexing of the edge into the open portion.

2. The shipping protection system according to claim 1 further comprising a bias means for biasing the at least one support member into engagement with the article.

3. The shipping protection system according to claim 2, wherein said bias means comprises a shipping carton adapted for receiving said first and second receiving surfaces therein.

4. The shipping protection system according to claim 1, wherein said article comprises a bottle.

5. The shipping protection system according to claim 4, wherein said yieldable support member comprises a portion adapted for engagement with a portion of the bottle, said support member having a flexible portion adapted to flex in a direction away from the portion of the bottle in presence of biasing pressure.

6. The shipping protection system according to claim 1, wherein said support member comprises a molded fiber support member.

7. The shipping protection system according to claim 1, further comprising first and second end engaging members in spaced relation to one another, one of said end engaging members being adapted to be removed from an engaging position so as to enable a longer article length to be accommodated.

8. A shipping protection system, for protecting an article during shipping comprising:

a first receiving surface for removable placement against a first portion of the article;

a second receiving surface for removable placement against a second portion of the article;

wherein at least one of said first and second receiving surfaces comprises a yieldable support member adapted for flexible engagement with the article for adaptable engagement with a variety of shape and configuration of articles, wherein said article comprises a bottle, wherein said yieldable support member comprises a portion adapted for engagement with a portion of the bottle, said support member having a flexible portion adapted to flex in a direction away from the portion of the bottle in presence of biasing pressure, and wherein said first and second receiving surfaces are provided on first and second bottle receiving portions, and wherein said support member comprises an arcuate portion of at least one of said bottle receiving portions, said arcuate portion and bottle receiving portion defining an opening along an edge portion of said arcuate portion for enabling flexing of said arcuate portion into and out of a plane of said shipping protector portion.

9. The shipping protection system according to claim 8, wherein said article comprises a bottle.

10. A bottle shipping system, comprising:

a first bottle receiving portion; and a second bottle receiving portion, said first bottle receiving portion having a flexible flange portion defined thereon adapted for engagement against a first portion of a bottle and said second bottle receiving portion having a flexible flange portion defined thereon adapted for engagement against a second portion of a bottle, whereby when said first and second bottle receiving portions are placed in face to face arrangement with a bottle therebetween, biasing of the receiving portions towards each other results in said flexible flange portions accommodating the bottle for secure engagement over a variety of bottle shape and size configurations, wherein said flexible flange portion of said first bottle receiving portion and said flexible flange portion of said second bottle receiving portion comprise a member having an edge defined adjacent an open portion, for enabling flexing of the edge into the open portion.

11. The bottle shipping system according to claim 10, further comprising a shipping carton adapted to receive said first and second bottle receiving portions therein, said shipping carton providing the biasing of the receiving portions towards each other.

12. The bottle shipping system according to claim 10, wherein said first and second bottle receiving portions comprises molded fiber.

13. The bottle shipping protector according to claim 10, wherein each said first and second portions further comprise first and second end engaging members in spaced relation to one another, one of said end engaging members being adapted to removed from an engaging position so as to enable a longer bottle length to be positioned within said portions.

14. The bottle shipping system according to claim 10, wherein said bottle comprises a wine bottle.

15. The bottle shipping protection system according to claim 10 further comprising first and second bottle end engaging members in spaced relation to one another in at least one said bottle receiving bay adjacent a bottle end receiving position, one said end engaging members being adapted to removed from an engaging position so as to provide a longer bottle receiving bay area to receive a bottle therein, to enable a longer article length to be accommodated.

16. A bottle shipping system, comprising:

a first bottle receiving portion having at least one bottle receiving bay therein; and a second bottle receiving portion having at least one bottle receiving bay therein, said first and second bottle receiving portions adapted for face to face placement of the bottle receiving bays thereof to define a bottle receiving cavity, said bottle receiving portions having a flexible flange portion defined in each bottle receiving bay adapted for engagement against a portion of a bottle, whereby when said first and second bottle receiving portions are placed in face to face arrangement with a bottle therebetween, biasing of the bottle receiving portions towards each other results in said flexible flange portions flexing to accommodate the bottle for secure engagement over a variety of bottle shape and size configurations, wherein each said flexible flange portion comprises a member having an edge defined adjacent an open portion, for enabling flexing of the edge into the open portion.

17. The bottle shipping system according to claim 16, wherein said first and second bottle receiving portions comprises molded fiber.

18. The bottle shipping system according to claim 17, further comprising a shipping carton adapted to receive said first and second bottle receiving portions therein, said shipping carton providing the biasing of the bottle receiving portions towards each other.

19. The bottle shipping system according to claim 16, wherein said bottle comprises a bottle.

20. The bottle shipping system according to claim 16, further comprising first and second end engaging members in spaced relation to one another, one of said end stop members being adapted to removed from an engaging position so as to enable a longer bottle length to be accommodated therein.

21. A shipping protection system, for protecting an article during shipping comprising:

a first receiving member for removable placement against a first portion of the article;

a second receiving member for removable placement against a second portion of the article;

wherein at least one of said first and second receiving members comprises a yieldable support member adapted for flexible engagement with the article for adaptable engagement with a variety of shape and configuration of articles, wherein said yieldable support member comprises an edge defined adjacent an opening defined through said at least one of said first and second receiving members, wherein said edge flexes into the open portion to adaptably engage with the variety of shape and configuration of articles.

22. The shipping protection system according to claim 21, wherein said first and second receiving members comprise molded fiber.

23. The shipping protection system according to claim 21, further comprising a shipping carton adapted to receive said first and second receiving members therein, said shipping carton providing the biasing of the receiving members towards each other.

* * * * *